US007066617B2

(12) United States Patent
Mandy et al.

(10) Patent No.: US 7,066,617 B2
(45) Date of Patent: Jun. 27, 2006

(54) DOWNWARD ILLUMINATION ASSEMBLY

(75) Inventors: Terry R. Mandy, Paradise Valley, AZ (US); Dalton J. Mandy, Paradise Valley, AZ (US); Brandon R. Mandy, Paradise Valley, AZ (US)

(73) Assignee: Man-D-Tec, Scottsdale, AZ (US)

( * ) Notice: Subject to any disclaimer, the term of this patent is extended or adjusted under 35 U.S.C. 154(b) by 54 days.

(21) Appl. No.: 10/614,547

(22) Filed: Jul. 7, 2003

(65) Prior Publication Data

US 2004/0052070 A1 Mar. 18, 2004

Related U.S. Application Data

(60) Provisional application No. 60/410,091, filed on Sep. 12, 2002.

(51) Int. Cl.
*F21S 8/00* (2006.01)

(52) U.S. Cl. ..... 362/147; 362/260; 362/362; 362/404

(58) Field of Classification Search ..... 362/147, 362/404, 364, 373, 260, 216, 294
See application file for complete search history.

(56) References Cited

U.S. PATENT DOCUMENTS 3,692,977 A * 9/1972 Duhamel et al. ..... 392/347
4,274,615 A * 6/1981 Chan et al. ..... 248/343
4,313,154 A * 1/1982 Capostagno et al. ..... 362/365
4,459,648 A * 7/1984 Ullman ..... 362/307
4,520,436 A * 5/1985 McNair et al. ..... 362/366
5,003,432 A * 3/1991 Mandy ..... 362/20
5,145,247 A 9/1992 Mandy
6,350,046 B1 * 2/2002 Lau ..... 362/364

* cited by examiner

*Primary Examiner*—John Anthony Ward

(74) *Attorney, Agent, or Firm*—Reising, Ethington, Barnes, Kisselle, P.C.

(57) ABSTRACT

A downward illumination assembly for directing light downward from the ceiling area of a room includes a lamp housing having a closed upper end, an open lower end disposed axially opposite the closed upper end, and a housing wall extending from around a periphery of the upper end to and defining the open lower end. The lower end is positioned adjacent an opening in a ceiling panel. A lamp is supported in a lamp socket within the lamp housing in a position to radiate light through the lower end of the housing and through the opening in the ceiling panel. A module is removably supported on the housing and carries the lamp socket. The lamp socket is removable from the lamp housing with the module to allow the lamp socket and/or associated wiring to be serviced or replaced without removing the lamp housing from the ceiling panel or disconnecting and lowering the ceiling panel from its support structure.

20 Claims, 5 Drawing Sheets

DOWNWARD ILLUMINATION ASSEMBLY

CROSS REFERENCE TO RELATED APPLICATION

This application claims priority from Provisional Application No. 60/410,091, filed Sep. 12, 2002 and entitled "Downward Illumination Assembly", which is incorporated by reference.

STATEMENT REGARDING FEDERALLY SPONSORED RESEARCH OR DEVELOPMENT

Not Applicable

BACKGROUND OF THE INVENTION

1. Field of the Invention

This invention relates generally to a downward illumination assembly for directing light downward from a ceiling.

2. Description of the Related Art Including Information Disclosed Under 37 CFR 1.97 and 1.98

It is known for a ceiling lamp to be supported above a ceiling panel, and to radiate light downward through an opening formed in the ceiling panel. In passenger elevator applications, ceiling lamps can be supported on the relatively rigid and structurally substantial steel or wood composite drop ceilings that are commonly incorporated into such structures. Because elevators generally include steel shells that are only approximately eight feet tall, the drop ceiling panels are suspended only approximately six inches below top panels of the steel elevator shells. This limits options for servicing components of elevator ceiling lamps, such as ballasts, lamp sockets and associated wiring, that are not accessible from below the ceiling panel of an elevator.

For example, U.S. Pat. No. 5,145,247 issued 8 Sep. 1992 to Mandy, discloses a downward illumination assembly for a passenger elevator. The assembly includes a lamp housing having a closed upper end and an open lower end disposed axially opposite the closed upper end. A tubular canister extends from around a periphery of the upper end, a lower end of the canister defining the open lower end of the housing. Two ceiling mount tabs extend radially outward from diametrically opposite positions on an outer surface of the canister. The ceiling mount tabs provide an engagement surface for screw fasteners connecting the lamp housing to an upper surface of an elevator ceiling panel, holding the canister in alignment with a hole formed in the ceiling panel for the downward passage of light. Two fluorescent lamp tubes are removably supported in respective lamp sockets supported within the lamp housing. A generally tubular trim bezel is friction fit within the tubular canister and is retained, at least in part, by spring clips supported on an inner surface of the canister. A side conduit fitting is aligned with a through hole in the canister and is supported on and extends radially outward from the canister to provide access to the lamp sockets for electrical wires. To service the ballast, lamp socket, or associated wiring, maintenance personnel must unfasten and lower the ceiling panel to gain access to those components. This is because the assembly is mounted on top of the ceiling panel and cannot easily be removed or manipulated from below through the opening formed in the ceiling panel.

What is needed is a downward illumination lamp that can be supported above a ceiling panel in a position to direct light downward through an opening in the ceiling panel while allowing for removal of lamp socket and ballast without requiring removal of the lamp housing. What is also needed is such an assembly that is easy to install on ceiling panels of varying thicknesses.

BRIEF SUMMARY OF THE INVENTION

A downward illumination assembly for radiating light from the ceiling area of a room is provided that includes a lamp housing having a closed upper end, an open lower end disposed axially opposite the closed upper end, and a housing wall extending from around a periphery of the upper end to and defining the open lower end. The lower end is configured to be positioned adjacent an opening in a ceiling panel. A ceiling mount is carried by the housing wall and is configured to provide an engagement surface for mounting the lamp over an opening in a ceiling panel. A lamp is supported in a lamp socket within the lamp housing in a position to radiate light through the lower end of the housing and through an opening in the ceiling panel. The downward illumination assembly also includes a module removably supported on the housing and carrying the lamp socket. The lamp socket is removable from the lamp housing with the module to allow the lamp socket and/or associated wiring to be serviced or replaced without removing the lamp housing from the ceiling panel or disconnecting and lowering the ceiling panel from its support structure.

According to another aspect of the invention, the lamp includes a fluorescent tube. A ballast is carried by the module and is configured to regulate current flow to the fluorescent lamp. The ballast is removable with the module from the housing.

According to another aspect of the invention, the module includes an opening aligned with an opening in the housing and extends radially outward from the lamp housing canister wall. The openings allow a fluorescent lamp to extend into the lamp housing from the lamp socket carried by the module.

According to another aspect of the invention, the assembly includes a current path that passes through the module to the lamp socket. The current path carries electrical current necessary to illuminate the lamp.

According to another aspect of the invention, the assembly includes a pair of fluorescent lamp tubes and a pair of sockets configured to removably receive the tubes. The use of two lamp tubes increases lighting intensity and allows one lamp tube to continue producing light when the other lamp tube has burned-out and until the burned-out tube can be replaced.

According to another aspect of the invention, the module carries the ballast so that the ballast is removable with the module from the housing. This allows service personnel to remove the ballast and/or associated wiring for service or replacement without removing the lamp housing from the ceiling panel or disconnecting and lowering the ceiling panel from its support structure.

According to another aspect of the invention, the housing wall defines a tubular canister and the ceiling mount includes at least two tabs carried at diametrically opposite positions on the canister and extending radially outward from an outer surface of the housing wall. The ceiling mount tabs are configured to provide an engagement surface for fasteners to provide an engagement surface for fasteners to mount the lamp housing on an upper surface of a ceiling panel surrounding the opening in such a panel.

According to another aspect of the invention, the module carries the ballast. The ballast is removable with the module from the housing to allow the ballast and/or associated wiring to be serviced or replaced without removing the lamp housing from the ceiling panel or disconnecting and lowering the ceiling panel from its support structure.

According to another aspect of the invention, the assembly includes a trim bezel having an upper reflector portion and a flange extending laterally outward from around a lower periphery of the upper reflector portion. The trim bezel upper reflector portion is supportable by friction fit in any position within a range of axial positions within the lamp housing. The trim bezel upper reflector portion is configured to pass through a hole in the ceiling panel that the housing is mounted to. The trim bezel is configured to be positioned within the lamp housing in a position where the flange is supported adjacent the lower surface of such ceiling panel to allow a single housing and bezel design to accommodate ceiling panels of varying thicknesses. This arrangement allows for installation of the assembly in ceiling panels having a wide range of thicknesses.

According to another aspect of the invention, the assembly includes spring clips supported at spaced locations on an outer surface of the trim bezel upper reflector portion. The trim bezel upper reflector portion is axially retainable within the range of axial positions within the housing by engagement with the spring clips.

According to another aspect of the invention, the trim bezel upper reflector portion has a tapered tubular shape and is configured to be received within the tubular canister-shaped housing wall. The flange is annular in shape and extends radially outward from around the lower periphery of the upper portion.

According to another aspect of the invention, the spring clips are directed downwardly such that a sharp distal edge of each clip serves to engage the inner surface of the housing wall. This allows easy insertion of the trim bezel into the housing and increases resistance to axial withdrawal of the trim bezel from the housing.

The invention also includes a method for servicing components housed in the module of the downward illumination assembly when the assembly is carried by and opens through an opening in a ceiling panel. The method includes providing a downward illumination assembly carried by a ceiling panel, the assembly including a downwardly-opening lamp housing, a ceiling mount carried by the lamp housing and configured to support the assembly on the ceiling panel, a lamp supported in a lamp socket within the lamp housing, and a module removably supported on the housing and carrying components of the assembly. Access is then gained to the area above the ceiling panel, the module is removed from the lamp housing, a component carried by the module is then serviced, and the module is re-installed on the lamp housing. When the ceiling panel is supported in a passenger elevator, the step of gaining access to the area above the ceiling panel includes opening an access door in the top panel of such elevator.

According to another aspect of the inventive method, the step of providing a downward illumination assembly includes connecting the housing to a top surface of the ceiling panel with the housing opening aligned with a hole formed through the ceiling panel, and inserting an upper portion of a trim bezel into the housing until the flange contacts the lower surface of the ceiling panel.

According to another aspect of the inventive method, the step of inserting the upper portion of the trim bezel into the housing includes causing the spring clips supported on the trim bezel to engage an inner surface of the housing. The spring clips allow for easy insertion while resisting extraction.

BRIEF DESCRIPTION OF THE SEVERAL VIEWS OF THE DRAWINGS

These and other features and advantages of the invention will become apparent to those skilled in the art in connection with the following detailed description and drawings, in which.

DETAILED DESCRIPTION

Figure 1:
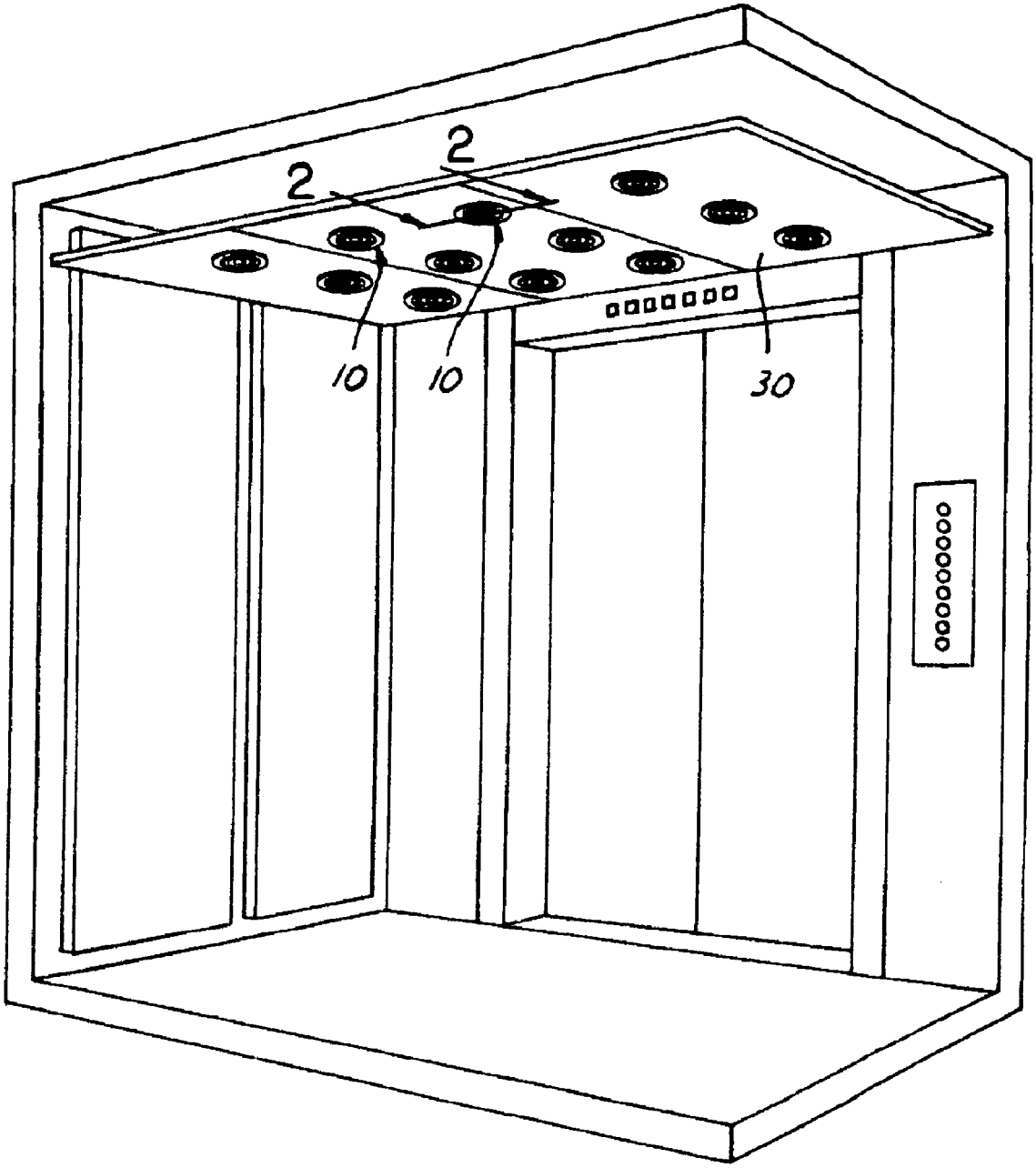
FIG. 1 is a partially cut-away isometric view of an elevator cab with a plurality of downward illumination assemblies constructed according to the invention and installed on a ceiling panel of the elevator cab.

A downward illumination assembly, or down lighting system, for radiating light from a ceiling is generally shown at 10 in the drawings. The assembly 10 includes a lamp housing 12 having a closed, circular disk-shaped upper wall or end 14 and an open circular lower end 16 that is disposed axially opposite the closed upper end 14. A housing sidewall 18 defines a tubular canister 20 of generally circular cross-section that extends axially downward from around a generally circular upper periphery 22 of the upper end 14 of the lamp housing 12 to a circular lower periphery 24 of the housing sidewall 18 that defines the open lower end 16 of the housing 12. A ceiling mount 28 is carried by the housing sidewall 18 in a position to engage a ceiling panel 30 and support the lamp housing 12 over an opening or hole 32 in a ceiling panel 30.

When installed, the lower end 16 of the housing 12 is positioned adjacent a circular opening 32 of similar size formed in a ceiling panel 30. The ceiling mount 28 includes four ceiling mount tabs 34 that extend radially outward from an outer surface 36 of the housing sidewall 18 and are carried at equally spaced positions around the housing sidewall 18. The ceiling mount tabs 34 provide separate spaced-apart engagement surfaces for fasteners 38 such as studs or screws to hold the housing 12 to the ceiling panel 30. The fasteners 38 pass downward through holes 40 in the ceiling mount tabs 34 and into an elevator ceiling panel 30 to mount the lamp housing 12 on an upper surface 42 of the ceiling panel 30 surrounding an opening 32 in such a panel 30. Ceiling panels 30 used in elevators are known to comprise a hard metal or composite wood capable of securely engaging the threads of a screw fastener.

As shown in FIGS. 2–6, at least one lamp 44 is supported in at least one lamp socket 46 within the lamp housing 12 in a position to radiate light through the lower end 16 of the housing 12 and through the opening 32 in the ceiling panel 30. As is also shown in FIGS. 2–6, the assembly 10 also includes a module 48 that is removably supported on the housing 12 and that carries the lamp socket 46. Because the lamp socket 46 and any lamp 44 supported by the socket 46 are carried by the module 48, they are removable from the lamp housing 12 with the module 48. This allows the lamp socket 46 and/or associated wiring to be serviced or replaced without removing the lamp housing 12 from the ceiling panel 30 or disconnecting and lowering the ceiling panel 30 from its support structure, e.g., an elevator roof.

Figure 6:
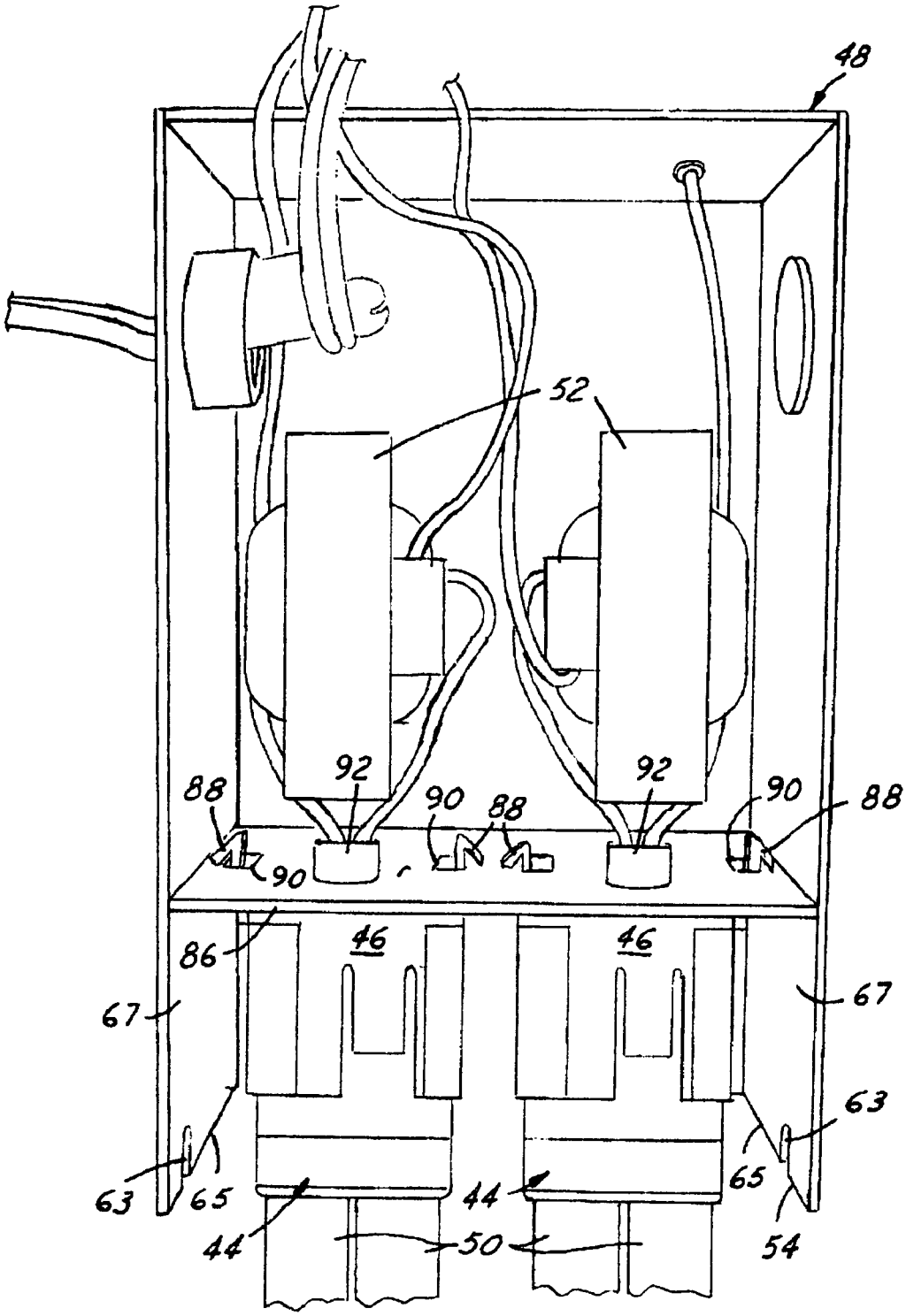
FIG. 6 is a perspective top view of the module of FIG. 5 with a cover of the module removed.

As best shown in FIG. 6, the present embodiment of the assembly 10 includes two lamps 44 supported in two lamp sockets 46. Each of the lamps 44 includes two fluorescent tubes 50. As shown in FIG. 6, two ballasts 52 are carried by the module 48 and regulate current flow to the respective lamps 44 and stabilize light output from the fluorescent tubes 50. Because the ballasts 52 are carried by the module 48, they are removable with the module 48 from the housing 12. As is well known, the ballasts 52 provide the proper voltage to establish light-emitting arcs between two electrodes disposed at respective opposite ends within each fluorescent lamp 44. The ballasts 52 also regulate the electric current flowing through the lamps 44 to stabilize light output from the lamps 44.

As best shown in FIGS. 2, 3, 5, and 6, the module 48 has a rectangular box shape and includes an open mating end 54 that is aligned with a pair of generally rectangular openings 56 formed adjacent one another in the lamp housing sidewall 18. The module 48 extends radially outward from the lamp housing sidewall 18. The two fluorescent lamp tubes 50 extend into the lamp housing 12 from their respective sockets 46, through the open mating end 54 of the module 48 and through the respective rectangular openings 56. The module 48 also includes a wiring cavity 58 having two electrical knockouts as shown in FIG. 6.

Figure 2:
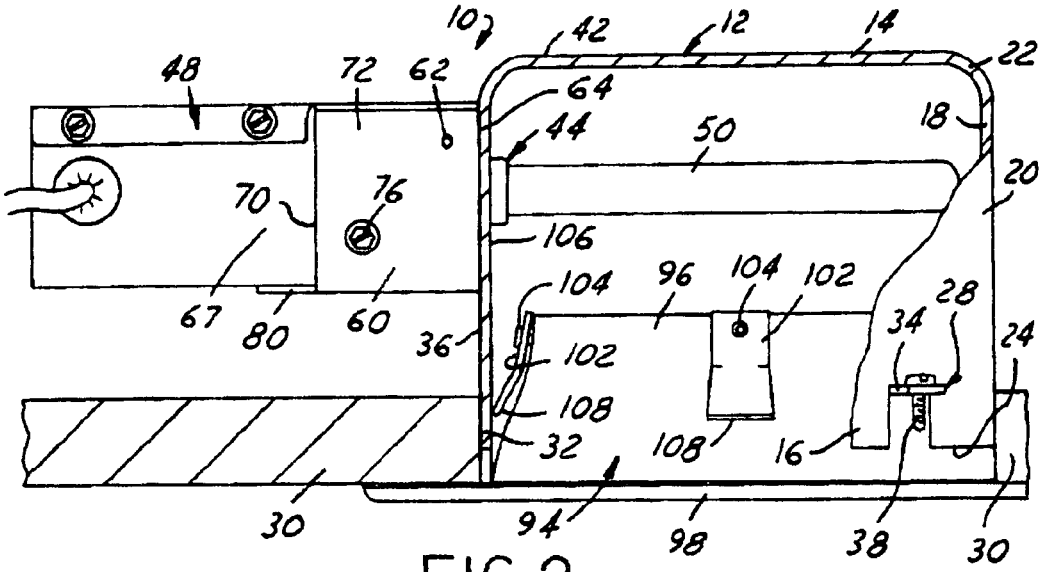
FIG. 2 is a cross-sectional side view of one of the downward illumination assemblies of FIG. 1 fastened to a top surface of the ceiling panel.
Figure 3:
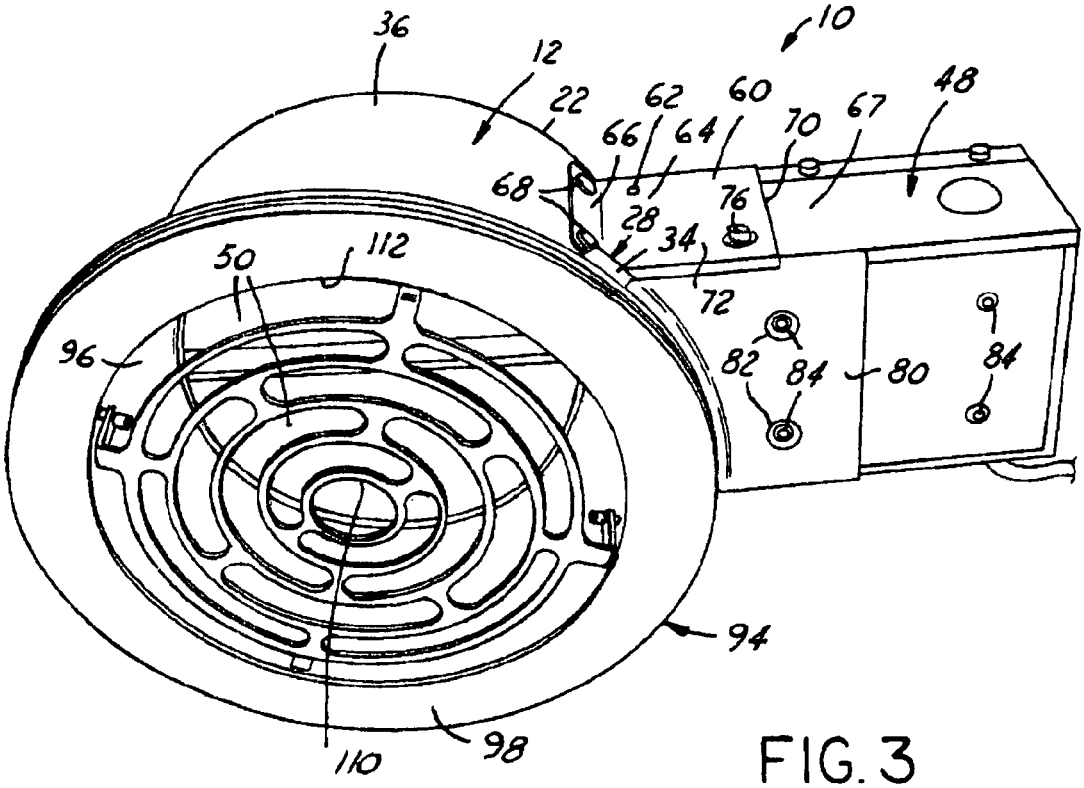
FIG. 3 is a perspective bottom and side view of an uninstalled downward lighting assembly constructed according to the invention.
Figure 4:
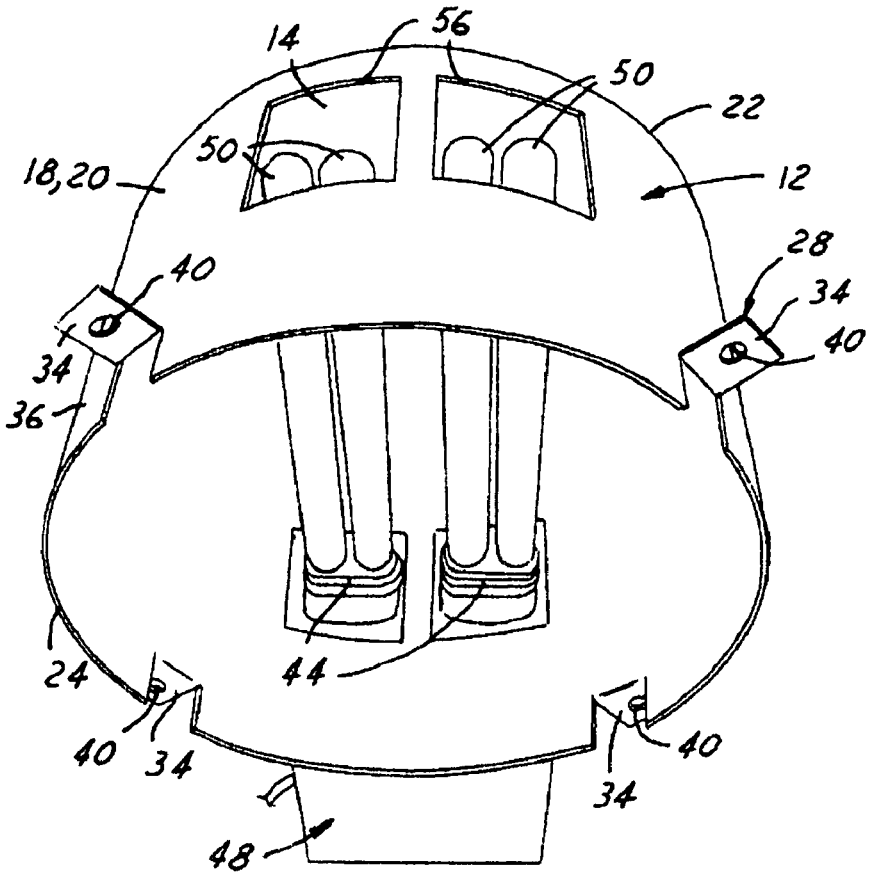
FIG. 4 is a perspective bottom and end view of the uninstalled downward lighting assembly of FIG. 3 with a reflector trim bezel of the assembly removed.
Figure 5:
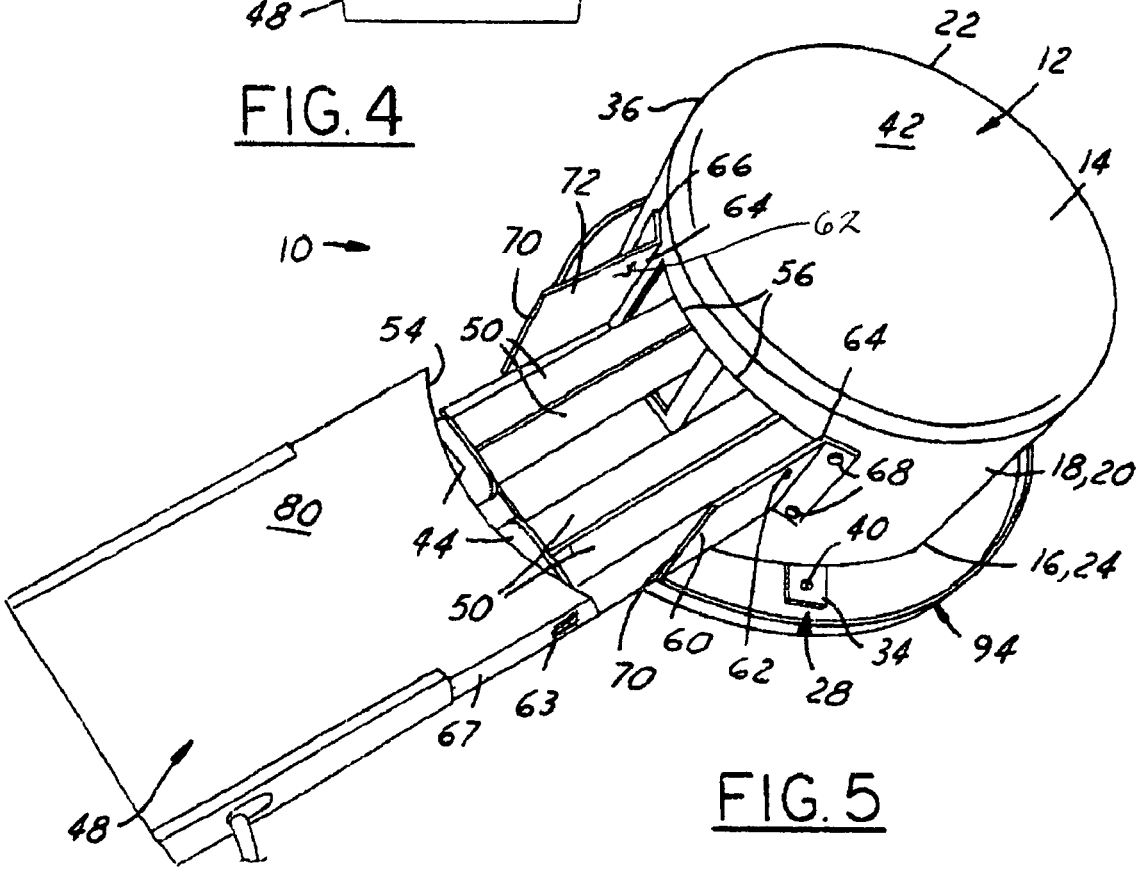
FIG. 5 is a perspective exploded top, side, and end view of the downward lighting assembly of FIG. 3 with a module of the assembly separated from a lamp housing of the assembly.

The assembly 10 also includes a module receptacle channel 60 as shown in FIGS. 2, 3, and 5. The module receptacle channel 60 is fastened to and extends laterally outward from the lamp housing sidewall 18. Together, the module 48 and the module receptacle channel 60 form a two-piece metal box and slide assembly 10, with the module 48 being the box and the module receptacle channel 60 being the slide. As best shown in FIGS. 2 and 3 the module receptacle channel 60 includes two keyway nubs 62 that extend into an interior of the channel 60 from opposite channel sidewalls 72. The nubs 62 are positioned to engage keyways 63 formed into leading edges 65 of respective sidewalls 67 of the module 48 to properly align the module 48 when the module 48 is inserted into the receptacle channel 60. Engagement of the nubs 62 in the keyways 63 also resists any downward movement of the module 48 relative to the lamp housing 12 once the module 48 has been inserted.

As best shown in FIG. 5, an inner end 64 of the module receptacle channel 60 is aligned with the two rectangular openings 56 in the lamp housing sidewall 18. The inner end 64 of the module receptacle channel 60 also includes circumferentially extending flanges 66 having flange through-holes for receiving fasteners such as pop rivets 68. In the embodiment shown in the drawings and photographs, pop rivets 68 extend through these flange through-holes and corresponding sidewall holes in the lamp housing sidewall 18 to hold the module receptacle channel 60 to the lamp housing sidewall 18.

The module receptacle channel 60 has a rectangular cross-section slightly larger than that of the open mating end 54 of the module 48 to allow the open mating end 54 of the module 48 to be removably received through an outer end 70 of the module receptacle channel 60 opposite the inner end 64 of the module receptacle channel 60. The module receptacle channel includes a pair of channel sidewalls 72 that each includes a receptacle screw mounting hole 74. The module sidewalls 67 each include a module screw mounting hole. When the module 48 is fully inserted into the module receptacle channel 60 the module and receptacle screw mounting holes align and a module release screw 76 is threaded into each pair of aligned holes as shown in FIGS. 2 and 3. This prevents the module 48 from being withdrawn from the module receptacle channel 60 without first removing the module release screws 76.

The module receptacle channel 60 also includes a channel bottom wall 80 that extends between and connects bottom edges of the channel sidewalls 72. As best shown in FIG. 3, the channel bottom wall 80 extends outwardly from the lamp housing sidewall 18 to a point beyond the module release screws 76 to increase the rigidity of the interface between the module 48 and the module receptacle channel 60 and to further resist downward movement of the module 48. The channel bottom wall 80 also includes channel relief holes 82 that allow the module 48 to interlock with the receptacle by receiving the heads of two pop rivets 84.

The pop rivets 84 fasten the ballasts 52 to the module. In other embodiments, any suitable fasteners may be used. The two sockets 46 are mounted to an internal module flange 86 of the module 48 as shown in FIG. 6. As is also shown in FIG. 6, socket tabs 88 extending from the sockets 46 snap into rectangular holes 90 in the internal module flange 86, which secures the sockets 46 in place. A plastic wire bushing 92 is supported in a hole located in the internal module flange 86 for each socket 46. The wire bushing 92 provides a wire-way for the socket wires to enter the wiring cavity 58 of the module 48.

The assembly 10 also includes a tapered cylindrical trim bezel shown at 94 in FIGS. 2, 3, 5, and 7. The Trim bezel 94 has an upper reflector portion 96 and an annular trim bezel flange 98 extending laterally outward from around a lower periphery of the upper reflector portion 96. The upper reflector portion 96 tapers inward as it extends upward from the annular trim bezel flange 98. The trim bezel reflector portion 96 is supportable by friction fit in any position within a range of axial positions within the lamp housing 12 despite its tapered shape. The trim bezel 94 is inserted into the lamp housing 12 through the circular ceiling panel hole 32 that is aligned with the open lower end 16 of the lamp housing 12 as best shown in FIG. 2. The trim bezel 94 is inserted until the trim bezel flange 98 is supported adjacent a lower surface 100 of the ceiling panel 30. Preferably, the trim bezel 94 is inserted until the trim bezel flange 98 engages the lower surface 100 of the ceiling panel 30 as shown in FIG. 2. The trim bezel flange 98 extends outward far enough to cover the interface between the lamp housing 12 and the hole 32 in the ceiling panel 30 and to provide an aesthetically pleasing appearance.

Figure 7:
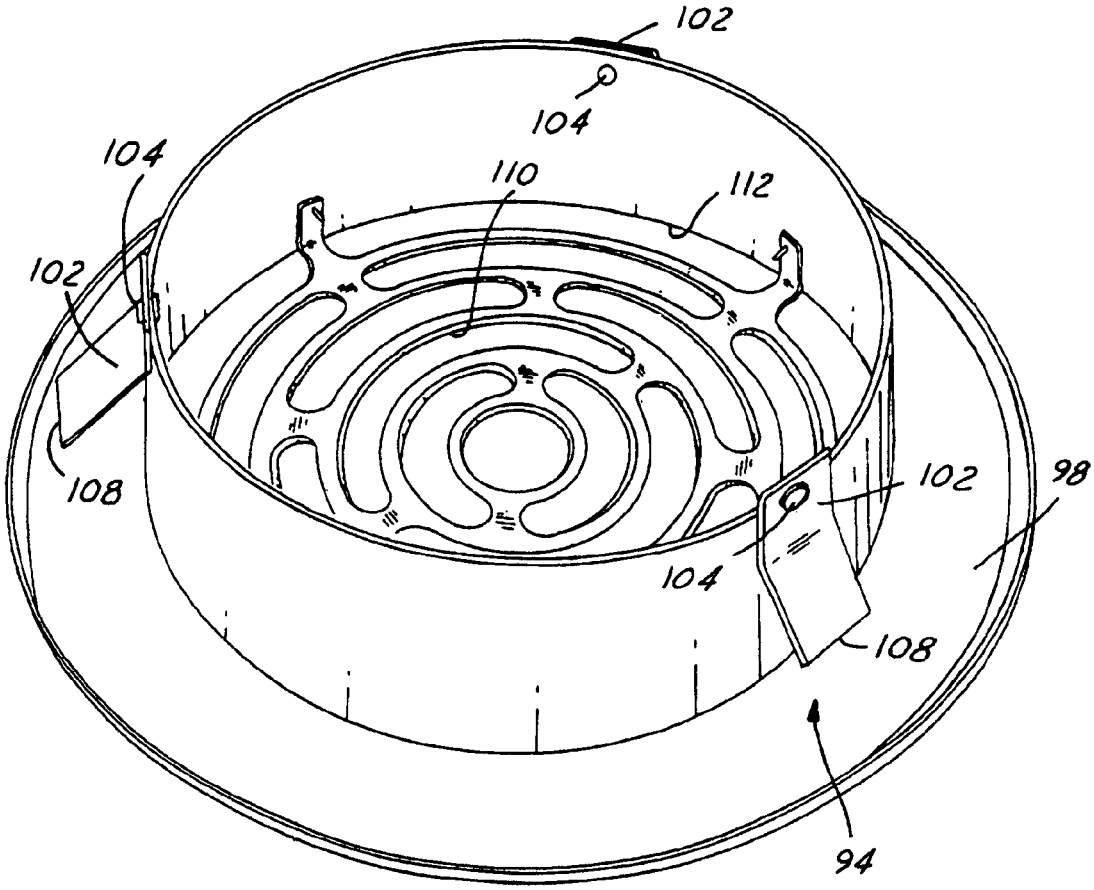
FIG. 7 is a perspective top and side view of the trim bezel reflector of the assembly.

The assembly 10 includes three spring clips 102 supported at spaced locations to an outer surface 104 of the upper reflector portion 96 of the trim bezel 94 as shown in FIGS. 2 and 7. Despite its tapered shape, the trim bezel upper reflector portion 96 is axially retainable within the range of axial positions within the housing 12 because the spring clips 102 are supported on the trim bezel reflector portion 96 rather than an inner surface 106 of the housing sidewall 18.

The spring clips 102 are directed downwardly such that a sharp distal edge 108 of each clip 102 serves to engage the inner surface 106 of the housing sidewall 18 to allow easy insertion of the trim bezel 94 into the housing 12 and to increase resistance to axial withdrawal of the trim bezel 94 from the housing 12. A single rivet 104 supports each spring clip 102 so that twisting the trim bezel upper reflector portion 96 within the lamp housing 12 can reduce resistance to axial withdrawal of the trim bezel 94. The twisting action causes the spring clips 102 to rotate about their respective connecting rivets 104 so that their sharp distal edges 108 are no longer directed downwardly and cannot provide as much resistance to axial withdrawal of the trim bezel 94.

In the embodiment shown in the drawings, and as shown in FIGS. 3 and 7, the trim bezel 94 includes a louver 110 that closes an annular opening 112 in the annular trim bezel flange 98. The louver 110 protects the lamps 44 from breakage.

In practice, components housed in the module 48 can be serviced by first gaining access to the area above the ceiling panel 30 that the assembly 10 is supported on. When the assembly 10 is supported on an elevator ceiling panel 30 as shown in FIG. 1, access to the area between the ceiling panel 30 and a top panel 30 of the elevator can be gained by opening an emergency exit door 112 in the top panel 30. The module 48 is then removed from the lamp housing 12 by reaching through the area between the elevator top panel 30 and its ceiling panel 30 and removing the two screws that fasten the module 48 to the module receptacle channel 60. Whatever components within the module 48 that might require servicing or replacement can then be attended to and the module 48 re-installed on the lamp housing 12. Re-installation of the module 48 is a simple reversal of the removal process. In elevator applications, once the module 48 has been re-installed, the emergency access door 112 to the elevator is closed.

The assembly 10 can be installed on a ceiling panel 30 by first connecting the housing 12 to the top surface of the ceiling panel 30 with the open lower end 16 of the housing 12 aligned with a hole 32 formed through the ceiling panel 30. More specifically, the housing 12 is positioned such that the ceiling mount tabs 34 rest on the top surface of the ceiling panel 30. Fasteners 38 are then passed through the holes in the ceiling mount tabs 34 and into the ceiling panel 30.

Once the housing 12 has been installed, the upper reflector portion 96 of the trim bezel 94 is inserted into the housing 12 until the trim bezel flange 98 contacts the lower surface 100 of the ceiling panel 30. As the upper reflector portion 96 of the trim bezel 94 is inserted into the housing 12, the spring clips 102 are compressed and provide a friction fit between the upper portion of the trim bezel 94 and the inner surface 106 of the housing sidewall 18.

The lamp housing 12, module 48, module receptacle channel 60, reflector trim bezel 94, and louver 110 are all made of metal. However, in other embodiments, these components may be fabricated from any suitable material.

This description is intended to illustrate certain embodiments of the invention rather than to the limit the invention. Therefore, it uses descriptive rather than limiting words. Obviously, it's possible to modify this invention from what the description teaches. Within the scope of the claims one may practice the invention other than as described.

What is claimed is:

1. A downward illumination assembly for directing light downward from the ceiling area of a room, the assembly comprising:

a lamp housing having a closed upper end, an open lower end disposed axially opposite the closed upper end, and a housing wall extending from around a periphery of the upper end to and defining the open lower end, the lower end configured to be positioned adjacent an opening in a ceiling panel;

a ceiling mount carried by the housing wall and configured to provide an engagement surface for mounting the lamp housing over an opening in a ceiling panel;

a lamp supported in a lamp socket within the lamp housing in a position to radiate light through the lower end of the housing and through the opening in the ceiling panel; and a module removably supported on the housing and carrying the lamp socket, the lamp socket being removable from the lamp housing with the module.

2. A downward illumination assembly as defined in claim 1 in which:

the lamp includes a fluorescent tube; and the module carries a ballast configured to regulate current flow to the fluorescent lamp, the ballast being removable with the module from the housing.

3. A downward illumination assembly as defined in claim 1 in which the module includes an opening aligned with an opening in the housing and extending radially outward from the lamp housing canister wall.

4. A downward illumination assembly as defined in claim 1 in which the assembly includes a current path that passes through the module to the lamp socket.

5. A downward illumination assembly as defined in claim 1 in which the assembly includes a pair of fluorescent lamp tubes and a pair of sockets configured to removably receive the tubes.

6. A downward illumination assembly as defined in claim 1 in which the housing wall defines a tubular canister and the ceiling mount includes at least two tabs carried at diametrically opposite positions on the canister and extending radially outward from an outer surface of the housing wall, the ceiling mount tabs being configured to provide an engagement surface for fasteners to mount the lamp housing on an upper surface of a ceiling panel surrounding an opening in such a panel.

7. A downward illumination assembly for directing light downward from the ceiling area of a room, the assembly comprising:

a lamp housing having a closed upper end, an open lower end disposed axially opposite the closed upper end, and a housing wall extending from around a periphery of the upper end to and defining the open lower end, the lower end configured to be positioned adjacent an opening in a ceiling panel;

a ceiling mount carried by the housing wall and configured to provide an engagement surface for mounting the lamp housing in an opening in a ceiling panel;

a lamp supported in a lamp socket within the lamp housing in a position to radiate light through the lower end of the housing and through the opening in the ceiling panel, the lamp socket being carried by a module that is removably supported on the housing;

a ballast electrically coupled to the socket and carried by the module and configured to regulate current flow to the fluorescent lamp through the socket;

the ballast being removable with the module and the socket from the housing.

8. A downward illumination assembly as defined in claim 7 in which the module carries the lamp socket, the lamp socket being removable from the lamp housing with the module.

9. A downward illumination assembly as defined in claim 7 in which the ceiling mount includes at least two ceiling mount tabs extending radially outward from an outer surface of the housing wall, the ceiling mount tabs being configured to provide an engagement surface for fasteners to mount the lamp housing on an upper surface of a ceiling panel surrounding the opening in such a panel.

10. A downward illumination assembly for directing light downward from the ceiling area of a room, the assembly comprising:

a lamp housing having a closed upper end, an open lower end disposed axially opposite the closed upper end, and a housing wall extending from around a periphery of the upper end to and defining the open lower end, the lower end configured to be positioned adjacent an opening in a ceiling panel;

a ceiling mount carried by the housing wall and configured to provide an engagement surface for mounting the lamp housing in an opening in a ceiling panel;

a lamp supported in a lamp socket within the lamp housing in a position to radiate light through the lower end of the housing and through the opening in the ceiling panel; and a trim bezel having an upper portion and a flange extending laterally outward from around a lower periphery of the upper portion, the trim bezel upper portion being supportable by friction fit in any position within a range of axial positions within the lamp housing and configured to pass through a hole in a ceiling panel that the housing is mounted to and to be positioned within the lamp housing such that the flange is supported adjacent the lower surface of such ceiling panel.

11. A downward illumination assembly as defined in claim 10 in which a module is removably supported on the housing and carrying the lamp socket, the lamp socket being removable from the lamp housing with the module.

12. A downward illumination assembly as defined in claim 10 in which a module is removably supported on the housing and carrying the ballast, the ballast being removable with the module from the housing.

13. A downward illumination assembly as defined in claim 10 in which the ceiling mount includes at least two ceiling mount tabs extending radially outward from an outer surface of the housing wall, the ceiling mount tabs being configured to provide an engagement surface for fasteners to mount the lamp housing on an upper surface of a ceiling panel surrounding the opening in such a panel.

14. A downward illumination assembly as defined in claim 10 in which the assembly includes spring clips supported at spaced locations on an outer surface of the upper reflector portion of the trim bezel, the trim bezel upper portion being axially retainable within the range of axial positions within the housing by engagement with the spring clips.

15. A downward illumination assembly as defined in claim 10 in which the trim bezel upper portion has a tapered tubular shape and is configured to be received within the tubular canister-shaped housing wall, the flange being annular in shape and extending radially outward from around the lower periphery of the upper portion.

16. A downward illumination assembly as defined in claim 14 in which the spring clips are directed downwardly such that a sharp distal edge of each clip serves to engage the inner surface of the housing wall.

17. A method for servicing components of a downward illumination assembly when the assembly is carried by and opens through an opening in a ceiling panel, the method comprising the steps of:

providing a downward illumination assembly carried by a ceiling panel, the assembly including a downwardly-opening lamp housing, a ceiling mount carried by the lamp housing and configured to support the assembly on the ceiling panel, a lamp supported in a lamp socket within the lamp housing, and a module removably supported on the housing and carrying components of the assembly;

gaining access to the area above the ceiling panel;

removing a module from the lamp housing;

servicing a component carried by the module; and re-installing the module on the lamp housing.

18. The method of claim 17 including, where the ceiling panel is supported in a passenger elevator, the step of gaining access to the area above the ceiling panel includes opening an access door in a top panel of such elevator.

19. The method of claim 17 in which the step of providing a downward illumination assembly includes connecting the housing to a top surface of the ceiling panel with the housing opening aligned with a hole formed through the ceiling panel and inserting the upper portion of a trim bezel into the housing until a flange of the trim bezel contacts the lower surface of the ceiling panel.

20. The method of claim 19 in which the step of inserting the upper portion of the trim bezel into the housing includes causing spring clips supported on the trim bezel to engage an inner surface of the housing wall.

* * * * *